US010471326B2

(12) United States Patent
Durham et al.

(10) Patent No.: US 10,471,326 B2
(45) **Date of Patent: *Nov. 12, 2019**

(54) BATTING TEE

(71) Applicant: The Hitting Tee LLC, San Jose, CA (US)

(72) Inventors: Jerry Durham, San Jose, CA (US); Anthony Paul Sanguinetti, San Jose, CA (US)

(73) Assignee: The Hitting Tee LLC, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/268,024

(22) Filed: May 2, 2014

(65) Prior Publication Data

US 2014/0243116 A1 Aug. 28, 2014

Related U.S. Application Data

(63) Continuation-in-part of application No. 13/308,445, filed on Nov. 30, 2011, now Pat. No. 8,747,258.

(60) Provisional application No. 61/427,378, filed on Dec. 27, 2010.

(51) Int. Cl.

| | |
|---|---|
| ***A63B 71/00*** | (2006.01) |
| ***A63B 69/00*** | (2006.01) |
| *A63B 102/18* | (2015.01) |

(52) U.S. Cl.

CPC .. *A63B 69/0075* (2013.01); *A63B 2069/0008* (2013.01); *A63B 2102/18* (2015.10); *A63B 2225/093* (2013.01)

(58) Field of Classification Search

CPC . A63B 69/0075; A63B 69/0002; A63B 63/06; A63B 69/00; A63B 69/0079; A63B 63/00; A63B 69/0091

USPC ..... 473/417, 451, 422–424, 429; D21/717, D21/780

See application file for complete search history.

(56) References Cited

U.S. PATENT DOCUMENTS

| | | | | |
|---|---|---|---|---|
| 1,477,233 A | | 12/1923 | Alexander | |
| 1,620,742 A | | 3/1927 | Spafford | |
| 2,527,906 A | * | 10/1950 | Bennett ..... | A63B 69/0075 473/417 |
| 2,534,132 A | | 12/1950 | Keefe | |
| 2,710,733 A | | 6/1955 | Phillips | |

(Continued)

OTHER PUBLICATIONS

Website, www.amazon.com/gp/product/B001VKAYJU/ref=pd_lpo_k2_dp_sr_1?pf_rd_p=486539851&pf_rd_s=lpo-top-stripe-1&pf_rd_t=201&pf rd_i=B0099YCLA&pf_rd_m=ATVPDKIKXODER&pf_rd_r=15ZDNR63CXF8SWPRF2J1, Heavy-Duty Rubber Batting Tee, three pages printed from the internet on Apr. 23, 2010.

(Continued)

*Primary Examiner* — Mitra Aryanpour

(74) *Attorney, Agent, or Firm* — Haverstock & Owens LLP

(57) ABSTRACT

A batting tee comprises a base for supporting the batting tee during use, a ball support column extending up from the base, and an extra ball holder for holding one or more extra balls before use. In some embodiments, the ball support column comprises one or more rigid sections and one or more flexible sections. The ball support column is adjustable to a desired height. In some embodiments, the extra ball holder surrounds the ball support column. In some embodiments, the extra ball holder is in the shape of a bucket.

20 Claims, 5 Drawing Sheets

(56) References Cited

U.S. PATENT DOCUMENTS

| | | | | |
|---|---|---|---|---|
| 2,749,147 | A | 6/1956 | Herrschaft | |
| 2,845,317 | A | 7/1958 | Orman | |
| 2,957,736 | A | 10/1960 | Munson et al. | |
| 3,006,647 | A | 10/1961 | Haskett | |
| 3,039,770 | A | 6/1962 | Ferretti | |
| 3,790,171 | A | 2/1974 | Anderson | |
| 3,876,203 | A | 4/1975 | Gold | |
| 3,883,138 | A | 5/1975 | Chorey | |
| 4,017,152 | A | 4/1977 | Allen | |
| 4,073,484 | A | 2/1978 | Beekenkamp | |
| 4,136,869 | A | 1/1979 | Tassone | |
| 4,160,549 | A | 7/1979 | Simpson | |
| 4,176,838 | A | 12/1979 | Griffin | |
| 4,227,691 | A | 10/1980 | Lefebvre et al. | |
| 4,383,686 | A | 5/1983 | Cardieri | |
| 4,445,685 | A | 5/1984 | Cardieri | |
| 4,575,080 | A | 3/1986 | Miles | |
| 4,629,188 | A | 12/1986 | Mahieu | |
| 4,692,050 | A | 9/1987 | Kaufman | |
| 4,700,498 | A | 10/1987 | Perutz et al. | |
| 4,819,937 | A | 4/1989 | Gordon | |
| 4,830,371 | A | 5/1989 | Lay | |
| 4,886,267 | A | 12/1989 | Licciardi et al. | |
| 4,938,478 | A | 7/1990 | Lay | |
| 4,995,845 | A * | 2/1991 | Hou | A63H 3/50 428/16 |
| 5,002,274 | A | 3/1991 | Bidema | |
| 5,320,343 | A | 6/1994 | McKinney | |
| 5,351,948 | A | 10/1994 | Thomas | |
| 5,388,823 | A | 2/1995 | Prieto | |
| 5,505,443 | A | 4/1996 | Padilla | |
| 5,540,430 | A | 7/1996 | Nichols et al. | |
| 5,967,910 | A | 10/1999 | Lin | |
| 6,045,462 | A | 4/2000 | Mourek | |
| 6,296,581 | B1 * | 10/2001 | Sever | A63B 47/002 473/415 |
| D451,566 | S | 12/2001 | DeChenne | |
| 6,358,163 | B1 | 3/2002 | Tanner | |
| 6,565,459 | B2 * | 5/2003 | Gormley | E04H 12/2246 473/417 |
| 6,682,445 | B1 | 1/2004 | Tanner | |
| 6,884,185 | B2 | 4/2005 | Udwin et al. | |
| D509,551 | S * | 9/2005 | Reynolds | D21/715 |
| 7,204,769 | B2 | 4/2007 | Bandimere et al. | |
| 7,255,658 | B1 * | 8/2007 | VanKuiken | A63B 69/0002 473/417 |
| 7,510,491 | B2 * | 3/2009 | Lortscher | A63B 69/0002 473/417 |
| 7,674,194 | B2 | 3/2010 | Lortscher | |
| 7,736,246 | B2 * | 6/2010 | Lortscher | A63B 69/0002 473/417 |
| 7,771,294 | B2 * | 8/2010 | Goucher | A63B 69/0002 473/422 |
| 7,976,413 | B2 | 7/2011 | Meltzer et al. | |
| 8,109,844 | B1 | 2/2012 | Quinn | |
| 8,246,492 | B2 | 8/2012 | Gangelhoff | |
| 8,747,258 | B2 * | 6/2014 | Durham | A63B 69/0075 473/417 |
| 2003/0036446 | A1 | 2/2003 | Udwin et al. | |
| 2003/0038426 | A1 | 2/2003 | Liao | |
| 2004/0185968 | A1 | 9/2004 | Livingstone | |
| 2006/0019773 | A1 * | 1/2006 | Newman | A63B 69/0002 473/417 |
| 2006/0199672 | A1 * | 9/2006 | Flanigan | A63B 47/007 473/417 |
| 2006/0264273 | A1 | 11/2006 | Liao | |
| 2007/0105662 | A1 | 5/2007 | Tanner | |
| 2007/0184921 | A1 * | 8/2007 | Smith | A63B 69/0002 473/453 |
| 2008/0064534 | A1 | 3/2008 | Lortscher | |
| 2008/0085787 | A1 | 4/2008 | Molloy et al. | |
| 2008/0254917 | A1 | 10/2008 | Fischer | |
| 2009/0093325 | A1 | 4/2009 | Meltzer et al. | |
| 2009/0149279 | A1 * | 6/2009 | Fischer | A63B 69/0002 473/417 |
| 2009/0312123 | A1 | 12/2009 | Liao | |
| 2010/0016100 | A1 | 1/2010 | Liu et al. | |
| 2011/0092317 | A1 * | 4/2011 | Burgess | A63B 69/0002 473/417 |
| 2011/0183782 | A1 | 7/2011 | Wang | |
| 2014/0243116 | A1 * | 8/2014 | Durham | A63B 69/0075 473/417 |

OTHER PUBLICATIONS

Website, www.homerunmonkey.com/homerun-easton-training-aid-tee-lid.html?mybuyscid=10157634295, Easton Tee Lid, two pages printed from the internet on Apr. 23, 2010.

* cited by examiner

BATTING TEE

RELATED APPLICATIONS

This Patent Application is a continuation-in-part of the U.S. patent application Ser. No. 13/308,445, filed Nov. 30, 2011, and entitled "BATTING TEE," which is hereby incorporated by reference in its entirety, and which claims the benefit of U.S. Provisional Patent Application Ser. No. 61/427,378, filed Dec. 27, 2010.

FIELD OF THE INVENTION

The present invention relates generally to games and sports equipment, and particularly to a batting tee having a telescoping support strut and replaceable upper ball holder extending therefrom.

DESCRIPTION OF THE RELATES ART

The concept of the batting tee and the associated game of tee ball have been known for some time. In its most basic sense, the batting tee is somewhat analogous to the golf tee, in that it supports the ball in an elevated, stationary mode for striking with the golf club or baseball bat.

Most batting tees developed to the present time are relatively lightweight in their construction to facilitate portability and storage. Such relatively lightweight tees generally do not hold up well for extended use, since many such tees are made almost entirely of lightweight plastic components that tend to deteriorate after some period of use. In some cases, these lightweight tees may not even last for one season of use.

As a result, tees formed of heavier and more durable materials have been developed. These tees are generally constructed of metal pipe with a metal base, providing a relatively inflexible structure. Such metal pipe batting tees are certainly more durable than lighter plastic tees, and are likely to last for several seasons of use. However, their very durability results in other problems for the user. A bat hitting this rigid metal structure, rather than hitting the ball supported atop the structure, will likely be damaged, at least to some extent.

Thus, a batting tee solving the aforementioned problems is desired.

SUMMARY OF THE INVENTION

The batting tee includes a base of high-density polyethylene plastic or other durable material. An adapter or bushing is installed in the base and a column of telescoping metal ball support pipes extend upward from the bushing. A protective rubber or plastic boot may be installed over the base of the support pipe assembly and bushing to provide a more pleasing appearance and to preclude the entry of sand, dirt, etc. into the threaded connections. The height of the telescoping pipe segments may be locked by a threaded collar at the top of each pipe section.

A flexible rod serves as the penultimate component, and a replaceable plastic ball holder extends from the upper end of the flexible rod. The replaceable plastic ball holder receives the greatest number of inadvertent strikes during play, and accordingly it may be easily replaced if damaged. The flexible rod (e.g., polycarbonate, etc.) can flex and bend when the replaceable ball holder is struck, but the flexible rod is less likely to be struck due to its distance below the upper end of the ball holder. Its durability also makes it much less likely to be damaged. A ball is removably placed on the ball holder, and is not tethered or permanently attached to the device. The batting tee may be adjusted to any desired height and used for practice, for rehabilitating the batter's swing, for tee ball, etc.

In one aspect, a batting tee comprises a flat, planar base providing stability for the batting tee when the batting tee is in use, the base having a threaded passage therethrough, a bushing threadably attached to the threaded passage of the base, a first rigid support column having a lower end and an upper end, the lower end threadably received within the bushing, a second rigid support column having a lower end and an upper end, the lower end of the second rigid support column telescopically coupled to the upper end of the first rigid support column, a flexible rod having a lower end and an upper end, the lower end telescopically coupled to the upper end of the second rigid support column, one or more securing mechanisms, each comprising a compression nut that is tightened in order to secure the batting tee at a desired height, and a ball holder received on the upper end of the flexible rod for supporting a ball. In some embodiments, the first rigid support column and the second rigid support column are metal. In some of these embodiments, the metal comprises corrosion resistant steel. In some embodiments, the base comprises a high-density polyethylene plastic. In some embodiments, the batting tee further comprises an extra ball holder for holding one or more extra balls before use. In some embodiments, the extra ball holder comprises a bucket. In some embodiments, the bucket surrounds the first rigid support column.

In another aspect, a batting tee comprises a flat, planar base providing stability for the batting tee when the batting tee is in use, a ball support column extending up from the base, a ball holder received on the upper end of the ball support column for supporting a ball during use, and an extra ball holder for holding one or more extra balls before use. In some embodiments, the ball support column comprises one or more rigid sections and one or more flexible sections. In some embodiments, wherein the ball support column is adjustable. In some embodiments, the extra ball holder surrounds the ball support column. In further embodiments, the extra ball holder comprises a rounded bucket like shape. In some embodiments, the base comprises a base of the extra ball holder. In further embodiments, the extra ball holder is configured to catch ball which are inadvertently miss hit.

In a further aspect, a batting system comprises a batting tee for supporting a ball and an extra ball holder coupled to the batting tee and for holding one or more extra balls before use with the batting tee. In some embodiments, the extra ball holder surrounds the batting tee. In some embodiments, the extra ball holder comprises a rounded bucket like shape. In further embodiments, the batting tee comprises a flat planar base. In some embodiments, the base comprises a base of the extra ball holder. In further embodiments, the extra ball holder is configured to catch ball which are inadvertently miss hit.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
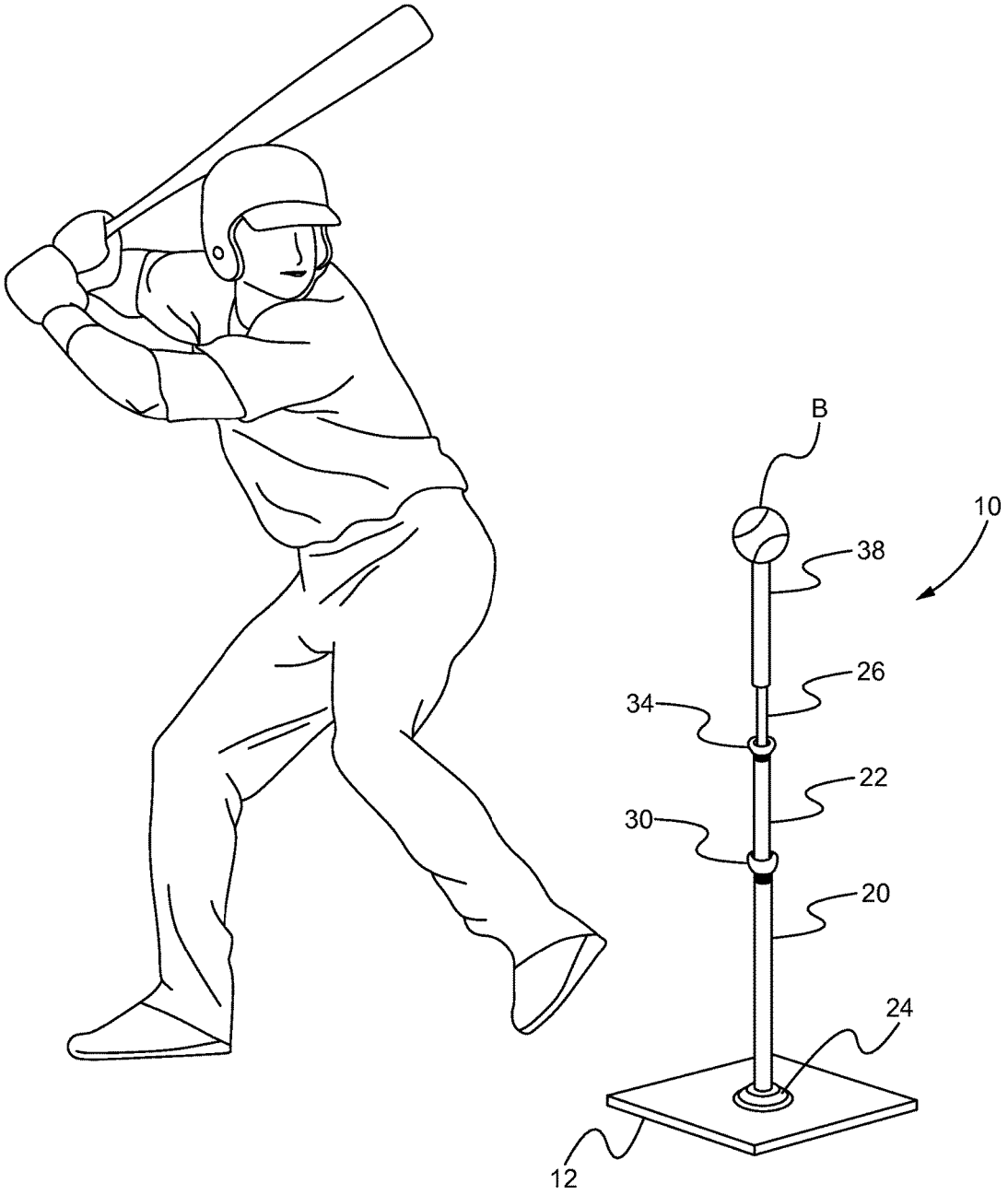
FIG. 1 is an environmental, perspective view of a batting tee according to the present invention.
Figure 2:
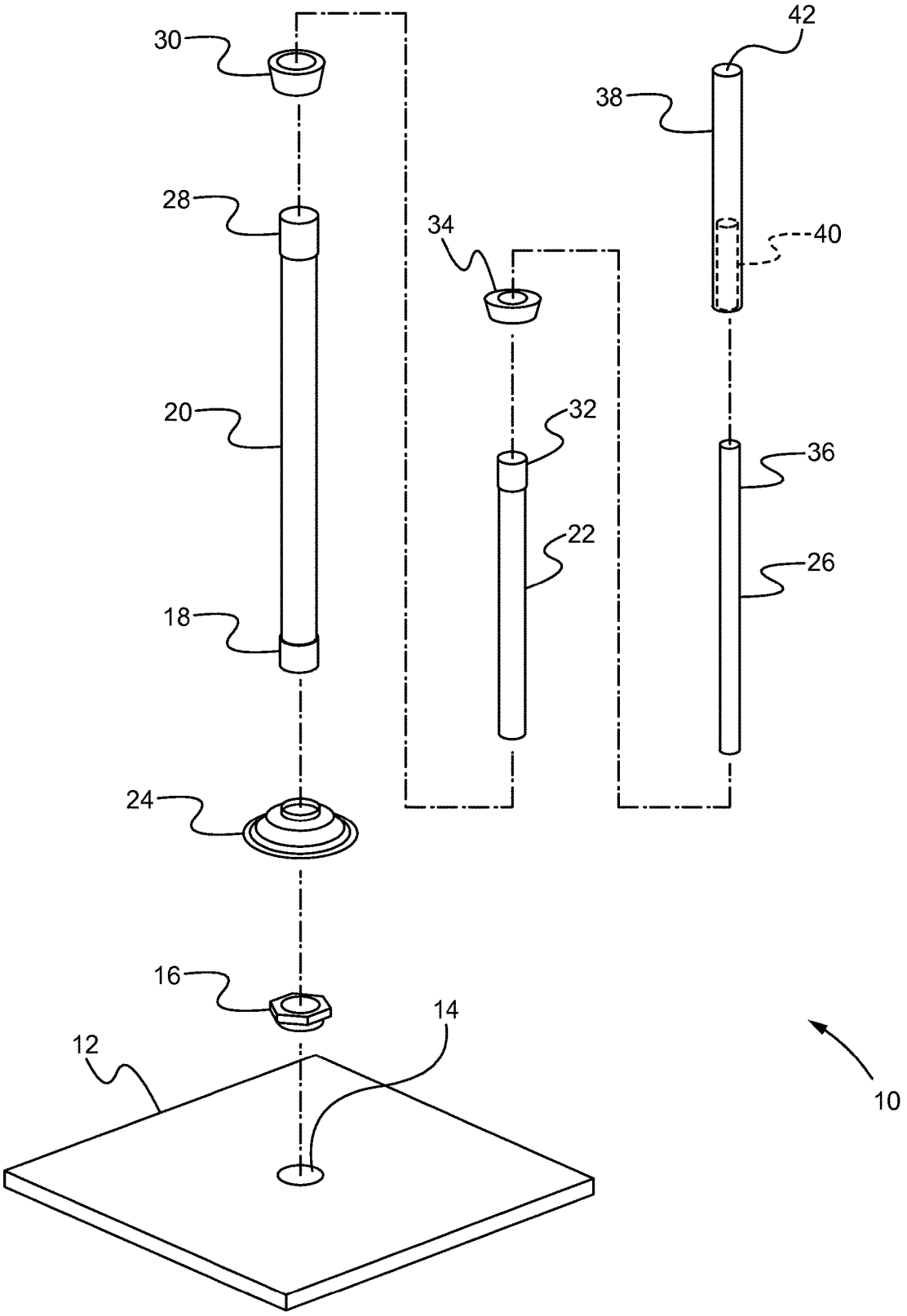
FIG. 2 is an exploded perspective view of the batting tee of FIG. 1, showing further details.
Figure 3:
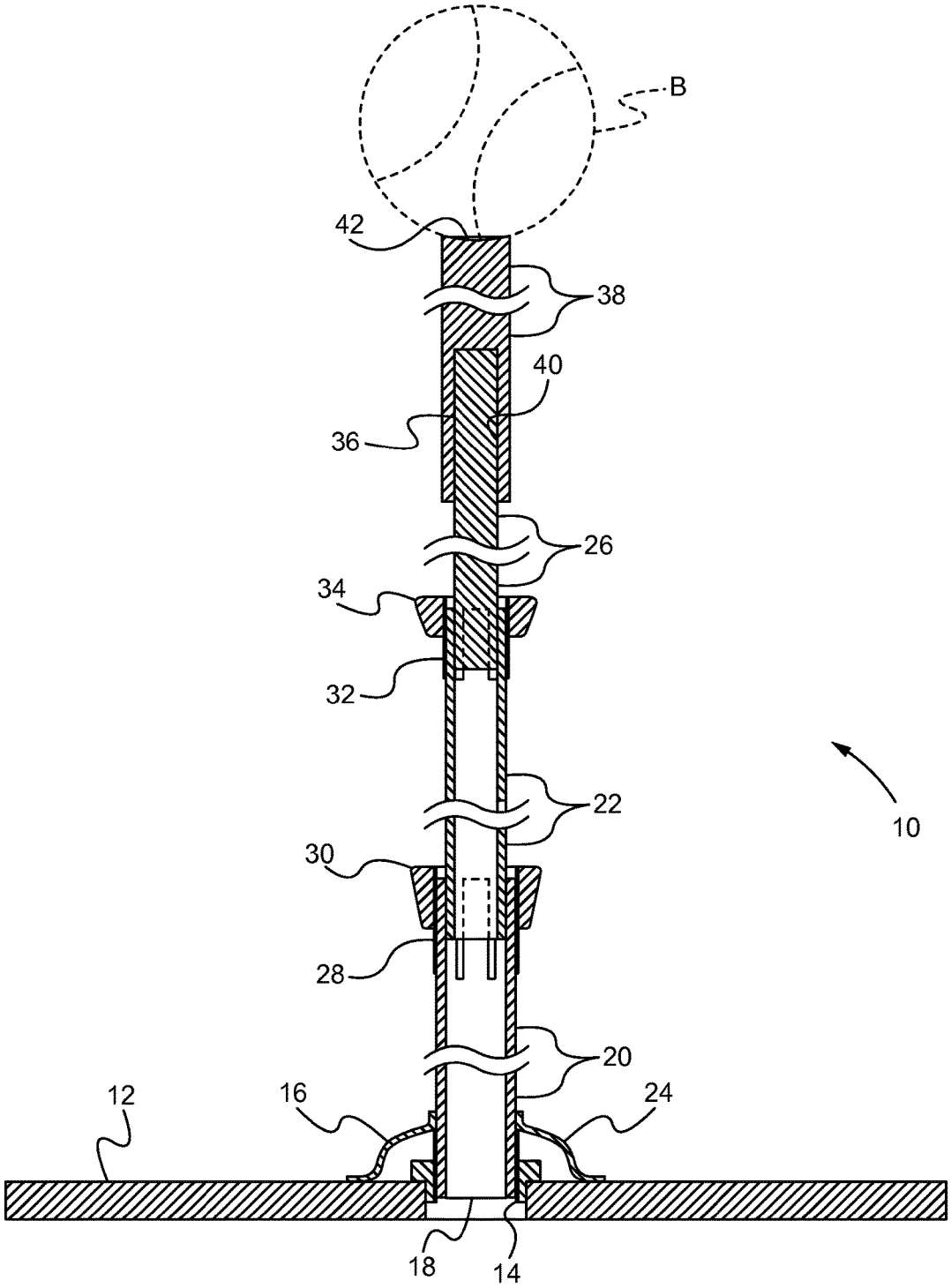
FIG. 3 is an elevation view in section of the batting tee of FIGS. 1 and 2, showing further details.

The batting tee 10 provides a device for practice in hitting a baseball, for rehabilitating a batter's swing, for playing tee ball, etc. FIG. 1 is an illustration of the batting tee 10 in use, with FIGS. 2 and 3 providing detailed views of the construction of the batting tee 10.

The batting tee 10 has a flat, planar base 12 of reasonably heavy and durable material to provide good stability. The base 12 is preferably formed of a thick sheet or plate of high-density polyethylene plastic (HDPE), but the base may be manufactured of any other suitable material. The base 12 includes a generally centrally located threaded passage 14 (FIGS. 2 and 3) defined therein. The male or externally threaded portion of a pipe bushing 16 is threadably installed in the passage 14 from the top of the base 12. This allows the bottom surface of the base 12 to remain free of protrusions, allowing the base 12 to rest in a stable configuration or other surface.

The female or internally threaded portion of the bushing 16 accepts the correspondingly threaded lower end or base 18 of a length of rigid pipe 20 serving as the ball support column (or a portion thereof) for the batting tee 10. The pipe 20 is preferably metal, and more preferably corrosion-resistant steel (e.g., "stainless steel"). A single length of pipe may be used as the ball support column, if desired, but preferably at least two telescoping lengths are provided for height adjustment. In the exemplary embodiment shown in the drawings, a small diameter pipe segment 22 telescopes within the lower and larger diameter pipe segment 20. A flexible boot 24 of rubber, plastic, or the like may be passed over the top of the ball support column and seated around the pipe bushing 16 to improve the appearance of the device and to seal out dirt and debris from the threaded pipe bushing connections in the base 12.

A flexible solid rod 26 is installed concentrically in the upper portion of the smaller diameter pipe segment 22. This solid rod 26 is preferably formed of a polycarbonate material, but other materials (e.g., fiberglass) may be used, if desired. The rigid pipe structure provided by the two pipe segments 20 and 22, along with the rigid attachment of the lower segment 20 into the base 12, provides excellent stability for the batting tee 10. However, flexibility is desired for the portion of the ball support column near the ball holder, in the event that the batter severely undercuts the ball. By forming the uppermost portion of the ball support column of a flexible rod 26, damage to the remainder of the batting tee 10 and/or the bat is avoided, or at least greatly reduced.

A compression nut is secured to the upper end of each of the pipe segments to selectively lock the relative positions of the pipe segments 20, 22 and the flexible rod 26 relative to one another. The externally threaded upper end 28 of the first or lower pipe segment 20 has an internally threaded first compression nut 30 installed thereon. The first compression nut 30 selectively grips the outer diameter of the second pipe segment 22 in secure relation to the top of the first segment 20. Similarly, the upper end 32 of the second pipe segment 22 has a somewhat smaller diameter compression nut 34 installed thereon, to selectively grip and lock the position of the flexible solid rod 26 therein. The upper end 28, 32 of each pipe segment 20, 22 has a plurality of radially spaced slots defined therein that extend from the edge of the pipe axially into the threaded portion so that the pipe segment 22 may be telescoped into the base segment 20 (or the flexible rod 26 may be telescoped into the pipe segment 22) to adjust the column to any desired height, the compression nuts 30, 34 clamping the slotted upper ends 28, 32 to the telescoping segment 22 or flexible rod 26. The three telescoping lengths of the ball support column, i.e., the first pipe segment 20, the second pipe segment 22, and the flexible solid rod 26, provide a wide range of vertical adjustment for the ball support column, allowing a ball placed thereon to be at the proper height for a wide range of ages and heights of hitters, and to simulate the heights of a wide range of pitches.

The upper end 36 of the flexible solid rod 26 defines the upper end of the ball support column. A ball holder 38 is installed atop the rod 26. The ball holder 38 is preferably formed of solid plastic and has a concentric receptacle 40 formed in its lower portion, which fits removably over the upper end 36 of the flexible solid rod 26. Thus, the ball holder 38 may be easily replaced on the flexible rod 26 if the holder 38 is damaged. The ball holder 38 also has a shallow depression 42 in its upper end, serving to hold or retain a baseball or softball B therein until the ball is struck by the hitter.

The batting tee 10 may remain assembled for storage, if desired, the support column segments 20 and 22 and the flexible rod 26 being retracted or collapsed as desired to reduce the height of the assembly. Alternatively, the lower or first support column segment 20 may be unscrewed from the bushing 16 in the base 12 for more compact storage. When the batting tee 10 is to be used, the lower support column segment 20 is reassembled in its bushing 26 as required, and the two ball support pipe segments 20 and 22 and the flexible rod 26 are extended to the height desired and locked by means of the two compression nuts 30 and 34. A ball B is placed in the shallow depression 42 atop the ball holder 38, and the batting tee 10 is ready for use. If a batter inadvertently strikes the plastic ball holder 38 or the flexible rod 26, the rod 26 flexes to deflect the impact force and the sturdy rigid pipe components 20 and 22 of the support column and their rigid attachment to the base 12 remain undamaged. In the event that the ball holder 38 is damaged, it is easily replaced by slipping a new ball holder 38 onto the upper end 36 of the flexible rod 26. If the batter strikes the ball B, the ball B leaves the ball holder on a trajectory that depends on the amount of contact between the bat and the ball B, the speed of the swing, the angle or levelness of the swing, etc. Accordingly, the batting tee 10 will provide durable and reliable service for many seasons of practice and play.

In some embodiments, a batting tee comprises an extra ball holder for holding one or more extra balls before use.

Figure 4:
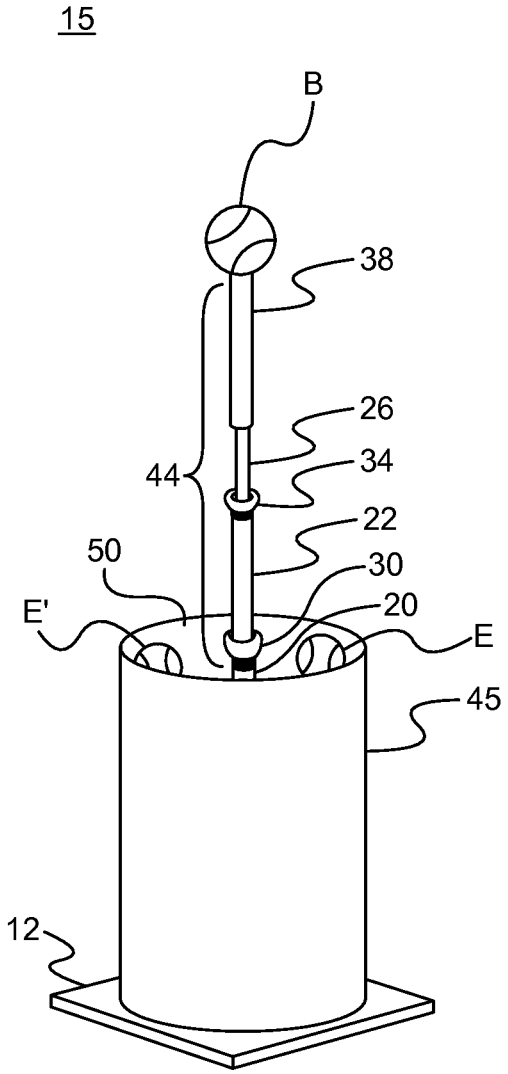
FIG. 4 illustrates a batting tee in accordance with some embodiments.

Referring now to FIG. 4, a batting tee is depicted therein. FIG. 4 illustrates a batting tee 15 comprising an extra ball holder 45 for holding one or more extra balls before use with the batting tee 15. In some embodiments, the batting tee 15 is similar to the batting tee 10 such as described above. The batting tee 15 comprises a base 12 for supporting the batting tee during use, a ball support column 44 and an extra ball holder 45 for holding one or more extra balls before use. As shown within FIG. 4, the extra ball holder 45 surrounds the ball support column 44. In some embodiments, the extra ball holder 45 is in the shape of a bucket. However, the extra ball holder 45 is able to comprise any appropriate shape for holding one or more extra balls before use with the batting tee 15. Additionally, as shown within FIG. 4, the base 12 is in addition to the extra ball holder 45, however, in some embodiments, the extra ball holder 45 comprises the base 12 and is able to stabilize the batting tee 15. Additionally, as described above, in some embodiments, the base 12 comprises a high-density polyethylene plastic. With the extra ball holder 45, a user is able to use the batting tee 15 to hit the ball B and then retrieve an extra ball E from the extra ball holder 45 for use.

The ball support column 44 comprises a bottom support column segment 20, a top support column segment 22, a flexible section 26 and a ball holder 38. In some embodiments, the bottom support column segment 20 and the top support column segment 22 comprise a first metal pipe segment and a second metal pipe segment. In some embodiments, the bottom support column segment 20 and the top support column segment 22 comprise corrosion resistant steel. As described above, a height of the ball support column 44 is adjusted by telescoping the bottom support column segment 20 and the top support column segment 22 and adjusting the compression nut 30 and the compression nut 34. This enables the ball support column to be adjusted to a variety of heights in order to place the ball B at a proper height for a wide range of ages and heights of hitters and to simulate the heights of a wide range of pitches.

In some embodiments, the extra ball holder 45 surrounds the ball support column 44 such that the extra ball holder 45 is able to catch balls that are inadvertently miss hit. For example, if a user inadvertently strikes the ball holder 38 or the flexible section 26, the flexible section 26 flexes to deflect the impact while the bottom support column segment 20 and the top support column segment 22 attached to the base 12 remain unchanged. In this scenario, the ball B is likely to fall off the ball holder 38 and into the extra ball holder 45 as the ball holder 38 moves with the flexing of the flexible section 26. Once in the extra ball holder 45, the ball B is easily retrieved and placed back on the ball holder 38 for use. Particularly, the extra ball holder 45 is able to catch a miss hit ball before it rolls away from the tee 15 and out of reach of the user.

Figure 5:
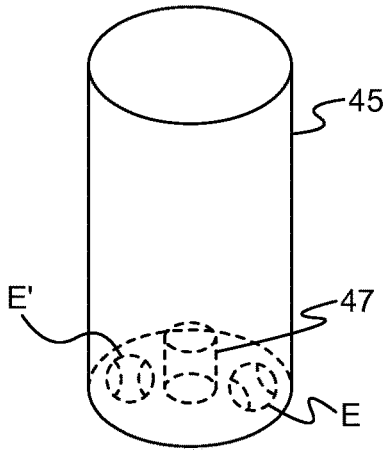
FIG. 5 illustrates an extra ball holder uncoupled from a ball support column and a batting tee in accordance with some embodiments.

FIG. 5 illustrates a front view of the extra ball holder 45 and its interior components without the ball support column 44. As shown in FIG. 5, in some embodiments, the extra ball holder 45 comprises a threaded passage 47 for receiving the ball support column 44. In some embodiments, the threaded passage 47 is similar to the threaded passage 14 as described above, and is able to receive a bushing 16 and threaded end 18 of the bottom support column segment 20. As further shown within FIG. 5, in some embodiments, the threaded passage 47 is raised up from a bottom of the extra ball holder 45. Raising the threaded passage 47 prevents the extra balls E and E' from blocking the threaded passage 47 and enables extra balls E and E' to be placed within the extra ball holder 45 without the ball support column 44. When the extra balls E and E' are placed within the extra ball holder 45, the raised threaded passage 47 forces the balls E and E' to the sides of the extra ball holder 45 and away from the threaded passage 47. Consequently, the ball support column 44 is easily coupled and uncoupled with the extra ball holder 45 with or without the extra balls E and E'. In some embodiments, the extra ball holder 45 is coupled to the base 12 by inserting the threaded end 18 of the bottom support column segment 20 through the threaded passage 47 and into the threaded passage 14 and coupling the support column segment 20 with the base 12, such as described above. Alternatively, in some embodiments, the extra ball holder 45 and the base are non-removably attached such that when the ball support column 44 is coupled with the threaded passage 47, it is also coupled with the base 12. Particularly, the extra ball holder 45 is able to couple with the base by any appropriate manner. In some embodiments, the extra ball holder 45 comprises the base of the batting tee.

Figure 6A:
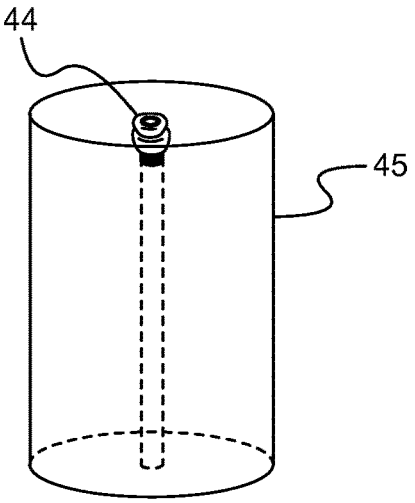
FIGS. 6A and 6B illustrate a batting tee in a retracted position in accordance with some embodiments.

In some embodiments, the ball support column 44 is able to retract into the extra ball holder 45. FIG. 6A illustrates the ball support column 44 in a retracted position. The ball support column is able to be retracted for storage or transportation of the batting tee. As shown within FIG. 6A, in a retracted position, the support column segments 20 and 22, the flexible rod 26 and the ball holder 38 are retracted or collapsed into each other in order to reduce the height of the assembly so that the ball support column 44 fits within the extra ball holder 45.

Figure 6B:
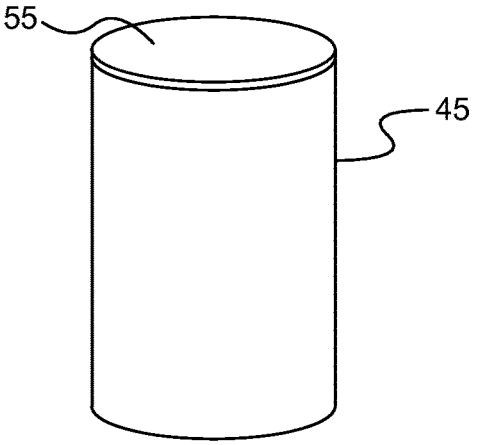

As shown within FIG. 6B, in some embodiments, a lid 55 is able to couple with the extra ball holder 45. Particularly, the ball support column 44 may be retracted or the lower or first support column segment 20 may be unscrewed from the base 12 and/or the extra ball holder and the lid 55 may be coupled with the extra ball holder 45 for storage.

In use, the batting tee and extra ball holder enables a user to hit a ball off the batting tee and quickly and easily retrieve an extra ball for use. For example, the user is able to hit a first ball from the tee and then retrieve a second ball in order to fine tune a batting swing and/or practice different hitting techniques. By quickly hitting balls from the tee and repeating swings, a user is able to develop muscle memory when practicing and/or rehabilitating the batter's swing. Additionally, because the batting tee is adjustable, the batter is able to adjust the tee to an appropriate height or location in order to practice the user's swing. Further, the batting tree maybe retracted into the extra ball holder and a lid may be placed on the extra ball holder for storage. Accordingly, the batting tee and extra ball holder as described herein has many advantages.

It is to be understood that the present invention is not limited to the embodiment described above, but encompasses any and all embodiments within the scope of the following claims.

We claim:

1. A batting tee comprising:

a. a flat, planar base configured to rest flat on a surface, providing stability for the batting tee when the batting tee is in use, the base having a threaded passage therethrough;

b. a bushing threadably attached to the threaded passage of the base;

c. a first rigid support column having a lower end and an upper end, the lower end threadably received within the bushing;

d. a second rigid support column having a lower end and an upper end, the lower end of the second rigid support column telescopically coupled to the upper end of the first rigid support column;

e. a flexible rod having a lower end and an upper end, the lower end telescopically coupled to the upper end of the second rigid support column;

f. one or more securing mechanisms, each comprising a compression nut that is tightened to compress one of one or more radially spaced slots of the upper end of the first rigid support column against the second rigid support column and one or more radially spaced slots of the upper end of the second rigid support column against the flexible rod in order to secure the batting tee at a desired height; and g. a ball holder received on the upper end of the flexible rod for supporting a ball.

2. The batting tee of claim 1, wherein the first rigid support column and the second rigid support column are metal.

3. The batting tee of claim 2, wherein the metal comprises corrosion resistant steel.

4. The batting tee of claim 1, wherein the base comprises a high-density polyethylene plastic.

5. The batting tee of claim 1, further comprising an extra ball holder for holding one or more extra balls before use.

6. The batting tee of claim 5, wherein the extra ball holder comprises a bucket.

7. The batting tee of claim 6, wherein the bucket surrounds the first rigid support column.

8. A batting tee comprising:

a. a flat, planar base configured to rest flat on a surface, providing stability for the batting tee when the batting tee is in use, the base having a threaded passage therethrough;

b. a bushing threadably attached to the threaded passage of the base;

c. a first rigid support column having a lower end and an upper end, the lower end threadably received within the bushing;

d. a second rigid support column having a lower end and an upper end, the lower end of the second rigid support column telescopically coupled to the upper end of the first rigid support column;

e. a securing mechanism which is tightened to compress one of one or more radially spaced slots of the upper end of the first rigid support column against the second rigid support column in order to secure the batting tee at a desired height; and f. a ball holder for holding a ball and coupled to the first rigid support column and the second rigid support column.

9. The batting tee of claim 8, wherein the second support column is adjustable in order to adjust a height of the ball holder.

10. The batting tee of claim 8, wherein the first rigid support column removably couples with the base.

11. The batting tee of claim 8, further comprising an extra ball holder for holding one or more extra balls before use.

12. The batting tee of claim 11, wherein the extra ball holder comprises a bucket.

13. The batting tee of claim 12, wherein the bucket surrounds the first rigid support column.

14. A batting tee comprising:

a. a flat, planar base providing stability for the batting tee when the batting tee is in use, the base having a threaded passage through a center of the base;

b. a bushing threadably attached to the threaded passage of the base;

c. a first rigid support column having a lower end and an upper end, the lower end threadably received within the bushing;

d. a second rigid support column having a lower end and an upper end, the lower end of the second rigid support column telescopically coupled to the upper end of the first rigid support column;

e. a securing mechanism which is tightened to compress one of one or more radially spaced slots of the upper end of the first rigid support column against the second rigid support column in order to secure the batting tee at a desired height; and f. a ball holder for holding a ball and coupled to the first rigid support column and the second rigid support column, wherein the ball holder is received on an upper end of a flexible rod coupled to the first rigid support column and the second rigid support column.

15. The batting tee of claim 14, wherein the second support column is adjustable in order to adjust a height of the ball holder.

16. The batting tee of claim 15, further comprising one or more securing mechanisms for securing the second support column in place.

17. The batting tee of claim 14, wherein the first rigid support column removably couples with the base.

18. The batting tee of claim 14, further comprising an extra ball holder for holding one or more extra balls before use.

19. The batting tee of claim 18, wherein the extra ball holder comprises a bucket.

20. The batting tee of claim 19, wherein the bucket surrounds the first rigid support column.

* * * * *